US009943945B2

(12) United States Patent
Chen

(10) Patent No.: US 9,943,945 B2
(45) Date of Patent: Apr. 17, 2018

(54) WATER PIPE WRENCH STRUCTURE

(71) Applicant: Jin Fu Chen, Taichung (TW)

(72) Inventor: Jin Fu Chen, Taichung (TW)

( * ) Notice: Subject to any disclaimer, the term of this patent is extended or adjusted under 35 U.S.C. 154(b) by 366 days.

(21) Appl. No.: 14/676,200

(22) Filed: Apr. 1, 2015

(65) Prior Publication Data

US 2016/0288298 A1 Oct. 6, 2016

(51) Int. Cl.
*B25B 7/10* (2006.01)

(52) U.S. Cl.
CPC ..... *B25B 7/10* (2013.01)

(58) Field of Classification Search
CPC B25B 7/10; B25B 13/46; B25B 13/12; B25B 13/14; B25B 13/08
USPC ..... 81/179, 413, 411, 409.5
See application file for complete search history.

(56) References Cited

U.S. PATENT DOCUMENTS 3,534,641 A * 10/1970 Le Duc ..... B25B 7/10 81/357
7,255,027 B1 * 8/2007 Tsai ..... B25B 7/10 81/357
8,770,067 B2 * 7/2014 Qiu ..... B25B 7/10 81/391
9,592,589 B2 * 3/2017 Wang ..... B25B 7/10
2012/0111157 A1 * 5/2012 Qiu ..... B25B 7/10 81/409

* cited by examiner

*Primary Examiner* — Monica Carter
*Assistant Examiner* — Lauren Beronja
(74) *Attorney, Agent, or Firm* — Ming Chow; Sinorica, LLC

(57) ABSTRACT

A water pipe wrench structure consisting of a first wrench body and a second wrench body pin jointed by a control component. The first wrench body includes an actuating piece. A tooth space is positioned on this actuating piece. This actuating piece and a tooth piece extend with a uniform curvature. The second wrench body includes a perforation to pass the control component through this perforation and the tooth space. This control component includes a column piece and a grinding tooth piece, and the grinding tooth piece can be moved by pressure, so that the grinding tooth piece can be engaged to or separated from the tooth space and thus end the movement of the control component.

4 Claims, 11 Drawing Sheets

WATER PIPE WRENCH STRUCTURE

BACKGROUND OF THE INVENTION

Field of the Invention

The present invention relates to water pipe wrench structures, particularly to a water pipe wrench with adjustable clamping diameter.

Description of the Related Art

Conventional water pipe wrenches, such as the ones shown in FIGS. 10 and 11 are formed of two wrench bodies 4, 5 hinged at an intersection point. Among these, a long straight tooth space 41 is found on one of the wrench bodies 4, and the other wrench body 5 is positioned in said tooth space 41 via a pivot 51 comprising ratchets 52; wherein said pivot 51 can be controlled so as to be separated from said tooth space 41, so that the wrench body 5 can make a sliding movement relative to the opposite wrench body 4, and in this way adjust the clamping diameter of the water pipe wrench. Afterwards, said pivot 51 can again be controlled to engage the ratchet 52 into the tooth space 41, so that the position of said pivot 51 would be fixed, and the clamping diameter for picking up objects would be set.

When the above said wrench body 5 is to be opened up, it can block the side face 42 of the wrench body 4 by means of a blocking piece 53 in order to provide the largest opening up width. However, the side face 42 of the wrench body 4 also corresponds to the shape of said tooth space 41 and forms a long straight shape, and this structural shape reduces the opening up width of the wrench body 5 during the opening up motion, which leads to inconvenience during use.

On the other hand, as shown in FIG. 11, a row of teeth structure 43 is found individually on both sides of said tooth space 41. Therefore, said teeth structure 43 has an upright appearance from top to bottom, which necessitates the user to completely separate said tooth space 41 using said pivot 51 and only after that he/she can adjust the position of the pivot 51 on the tooth space 41, which also forms another inconvenient drawback in usage.

SUMMARY OF THE INVENTION

The main purpose of the present invention is to provide a water pipe wrench structure, which comprises a wrench body having a tooth space and a side edge that has a curved shape so as to enable another wrench body to open up with a larger width, and thus enhance the operability and convenience during use.

In order to achieve this purpose, the present invention provides a water pipe wrench structure, comprising:

a first wrench body, which comprises a first clamping piece and a first handle piece at its two ends, respectively, and an actuating piece is positioned between said first clamping piece and said first handle piece, and a penetrating tooth space is found on said actuating piece, and said tooth space comprises a plurality of teeth separately on the left and right sides; wherein the distance between the teeth found at the two sides of said tooth space is defined by the width of the tooth space, and said tooth space has a curved shape facing towards said first handle piece, and the side edge of said actuating piece also has a curved shape corresponding to curved the shape of said tooth space;

a second wrench body, which comprises a second clamping piece and a second handle piece at its two ends, respectively, and a perforation with a stepped surface is positioned between said second clamping piece and said second handle piece; wherein said second wrench body and its perforation directly face the tooth space of said first wrench body and also intersect with said first wrench body on top of each other; a blocking piece is positioned near said second clamping piece of said second wrench body, and thus, when said second wrench body is opened with regard to said first wrench body, said blocking piece is blocked by the side face of the actuating piece of said first wrench body, so that the opening up width of said second wrench body would be restricted;

a control component, which comprises a column piece with a smaller outer diameter than the width of said tooth space, and a pressing piece is found at the top of said column piece, and the bottom part is encircled within a grinding tooth piece and a base plate; the column piece of said control component is passed through said perforation and said tooth space, and said pressing piece is positioned on top of said stepped surface; the position of said grinding tooth piece can be changed by pressing on said pressing piece and as a result, it engages with or breaks away from the teeth of said tooth space.

Among these, a flexible component is positioned around the column piece of said control component, and the two ends of said flexible component are pushed against said pressing piece and said stepped surface, respectively.

Moreover, the invention also comprises a bridge joint component, wherein said bridge joint component and said second wrench body are separately positioned at the lower and upper sides of the tooth space of said first wrench body, and said bridge joint component and said second wrench body are solid jointed, and the base plate of said control component is passed through said bridge joint component. Also, two connection blocks are positioned on said second wrench body in the form of protrusions, and these two connection blocks are individually placed at the two sides of the actuating piece of said first wrench body, and thus the two ends of said bridge joint component are separately fixed on these two connection blocks.

In one embodiment, one side among the upper and lower sides of the teeth found on said tooth space extend towards each other and cause the width of said tooth space to take a form that is narrower at the upper part while wider at the lower part, or that is wider at the upper part while narrower at the lower part, and the grinding tooth piece of said control component also corresponds to the shape and width of said tooth space.

In another embodiment, the forging flow line of said first wrench body extends along the extension direction of said first wrench body, and the forging flow line of said second wrench body extends along the extension direction of said second wrench body.

The characteristics of the present invention are as follows:

1. First, the two wrench bodies can be manufactured with the path of forging flow line towards the direction of holding, and using the bridge joint component, the first and the second wrench bodies can be intersected and pin jointed at one point, and a hole with a passage to the first wrench body is not required to be opened on the second wrench body; and therefore, the first and second wrench bodies can have relatively higher structural strength, and also the first and second wrench bodies can be readily connected via the bridge joint component during assembly, which would make the assembly operation more convenient and quicker.

2. The two ends of said flexible component can have shapes with different sectional areas, for instance a conical shape, which would enable better mounting of the flexible component on the stepped surface, or in other words, when the stepped surface part is narrowed down, said conical flexible component can appropriately be fitted and mounted on the stepped surface, which accordingly improves the convenience in assembly.

3. Said angle restriction body (grinding tooth piece, base plate) is manufactured by forging/metal injection, and the forging/metal injection method enables the metal to take the desired shape effectively while retaining the strength of the metal, as well as changing or adjusting the direction of metal flow line has more consistency, and also retains the clamping strength and durability of the grinding tooth piece.

The purposes and advantages of the above disclosed present invention can be understood better with the below given detailed description of the preferred embodiments and attached figures.

DETAILED DESCRIPTION OF THE PREFERRED EMBODIMENTS

Figure 1:
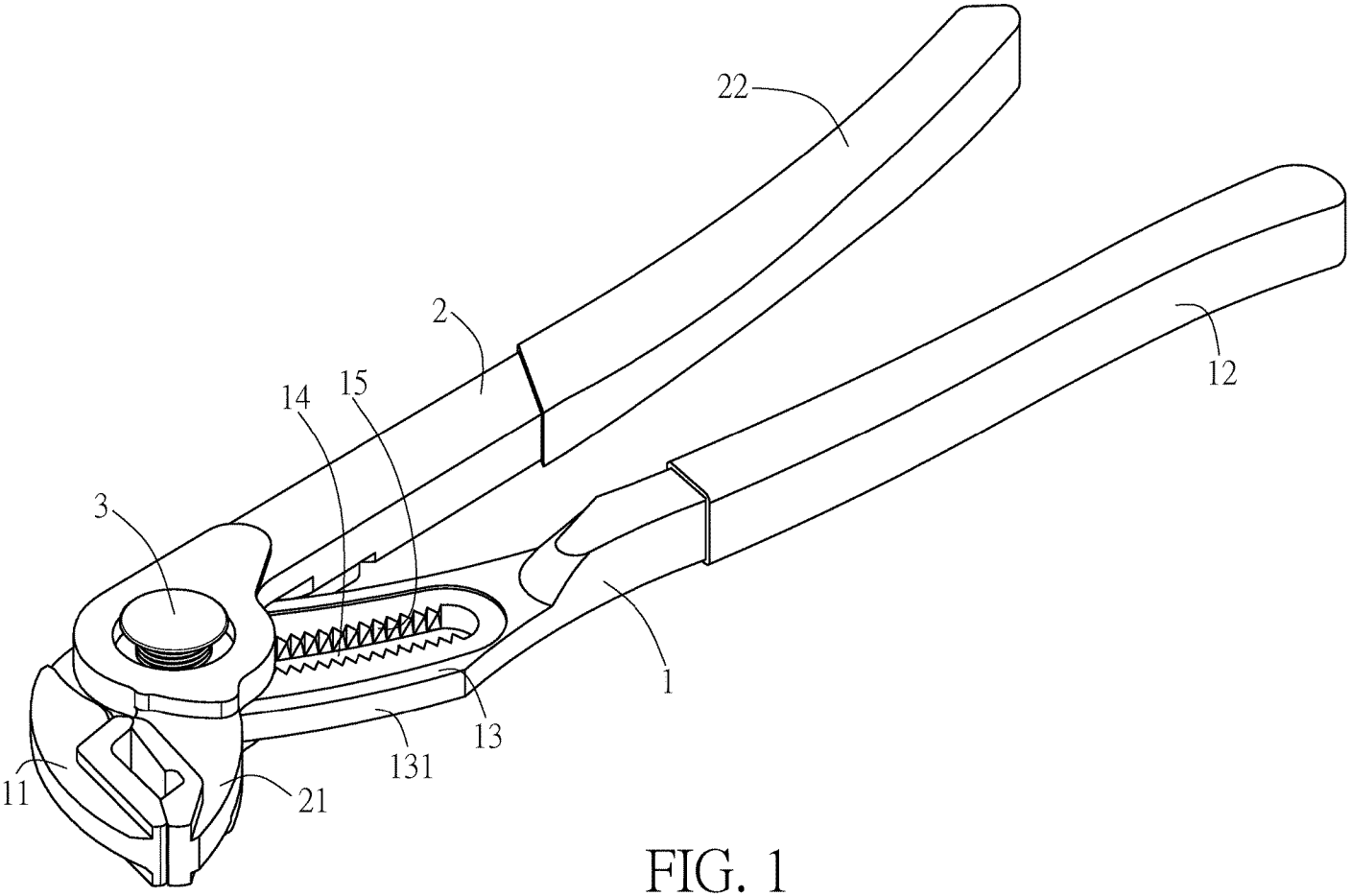
FIG. 1 is a three dimensional drawing of the present invention.
Figure 2:
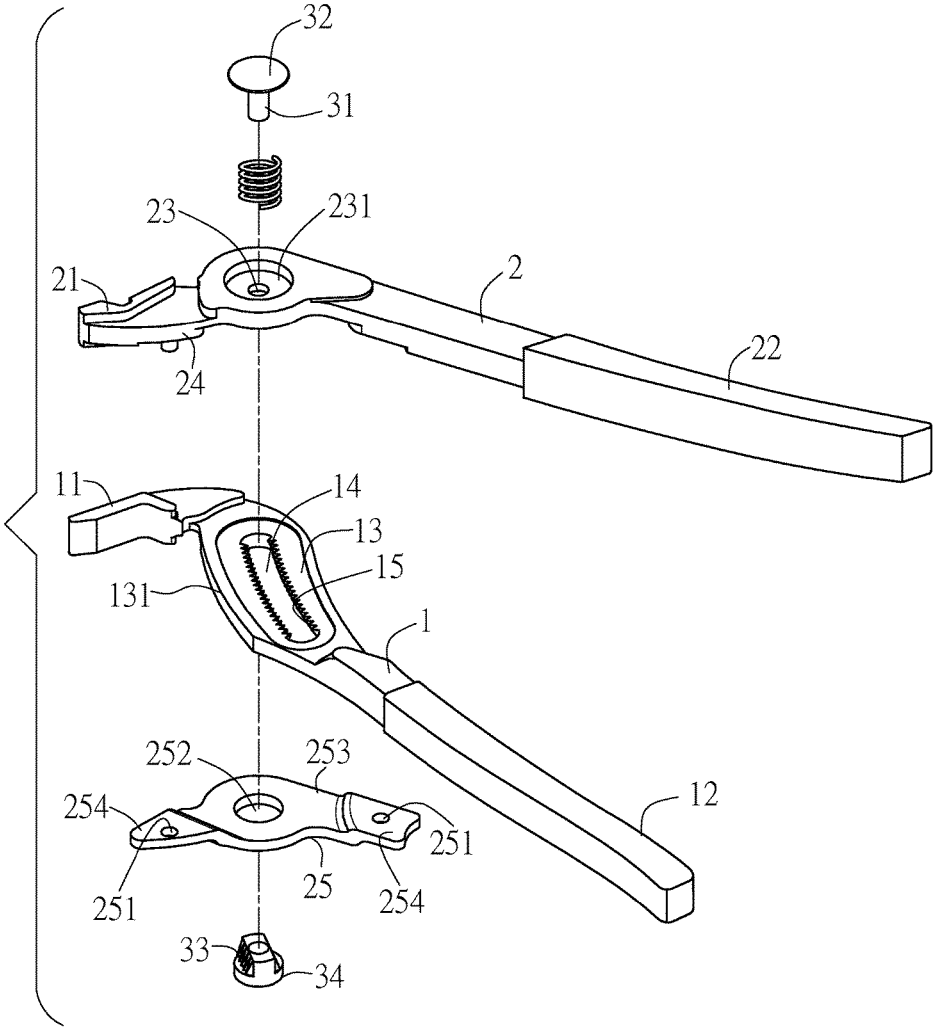
FIG. 2 is an exploded three dimensional drawing of the present invention.
Figure 3:
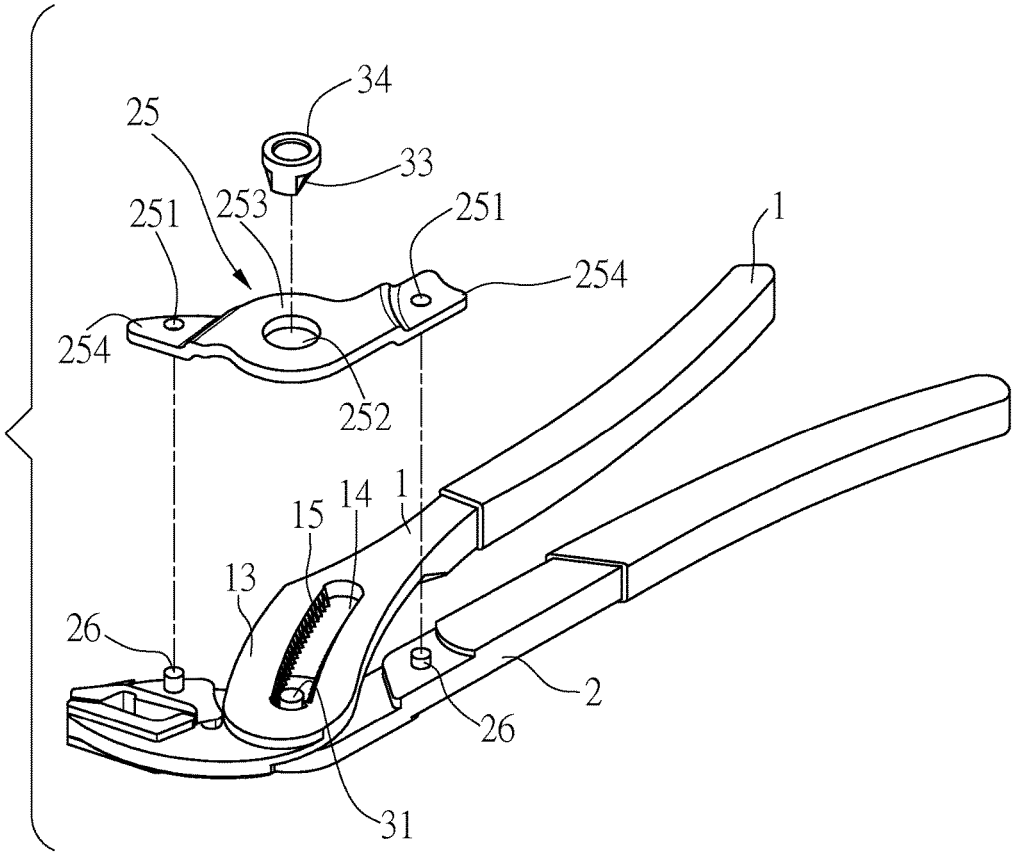
FIG. 3 is a partial exploded three dimensional drawing of the present invention from another angle.
Figure 4:
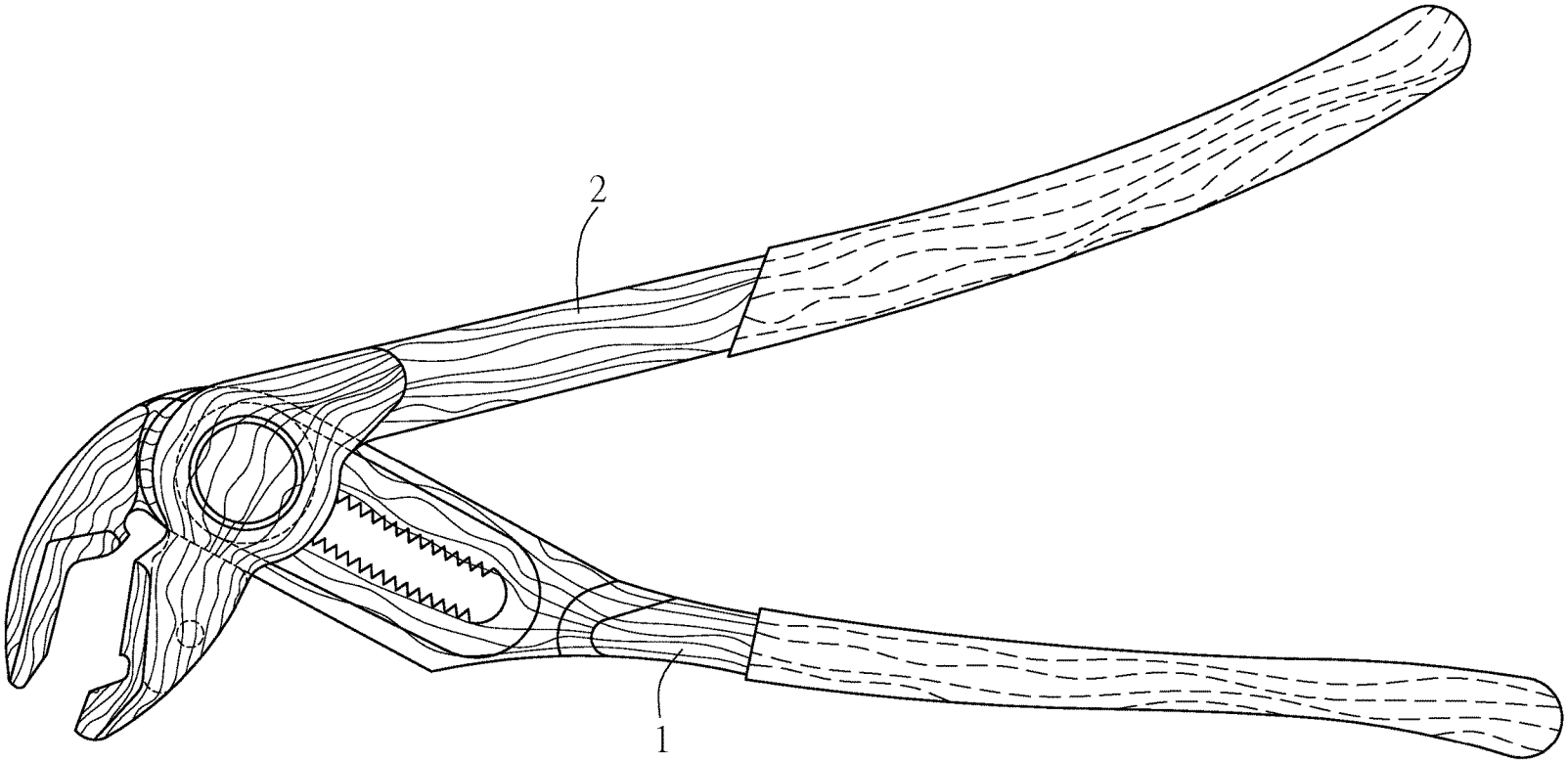
FIGS. 4 and 5 are plan view drawings of the present invention, showing its forging flow line.
Figure 5:
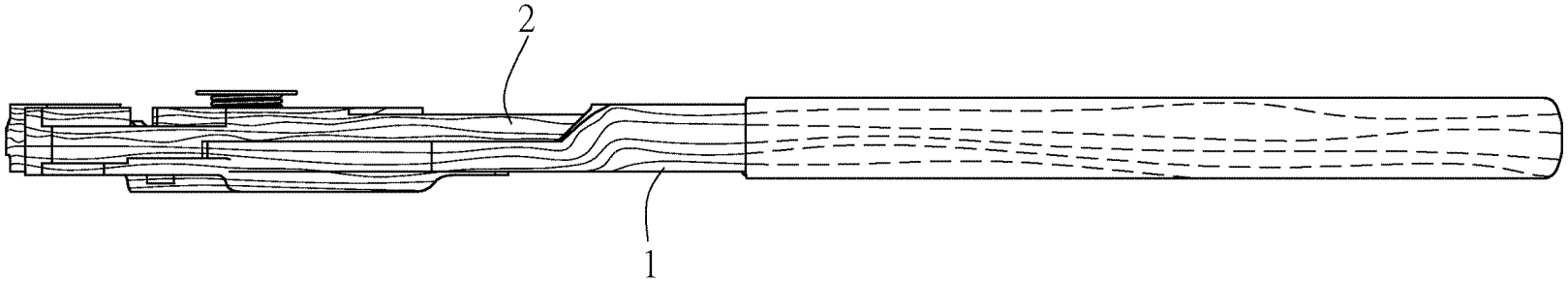

In FIGS. 1 to 3, the water pipe wrench structure of the present invention is shown, which mainly comprises a first wrench body 1, a second wrench body 2, and a control component 3. Among these, said first wrench body 1 has a first clamping piece 11 and a first handle piece 12 on its two ends, respectively; and said second wrench body 2 has a second clamping piece 21 and a second handle piece 22 on its two ends, respectively. Moreover, the forging flow line of the above said wrench bodies 1, 2 extends along the extension direction of the wrench bodies 1, 2 as shown in FIGS. 4 and 5, and as a result increases the tensile strength of the two wrench bodies 1, 2 in this direction.

Accordingly, said first wrench body 1 comprises an actuating piece 13 between said first clamping piece 11 and said first handle piece 12, and said actuating piece 13 comprises a penetrating tooth space 14. Said tooth space 14 comprises a plurality of teeth 15 separately on the left and right sides. Furthermore, said tooth space 14 is defined in the form of an arc facing said first handle piece 12, and one side face 131 of said actuating piece 13 is also in the form of an arc corresponding to the shape of said tooth piece 14. Besides, the distance between the teeth 15 of the two sides of said tooth space 14 is defined by the width of the tooth space 14, and in this embodiment, each tooth 15 extends facing one another in an inclined manner towards the upper portion, and as a result the width of said tooth space 14 varies from a narrower upper portion to a wider lower portion. On the contrary, each tooth 15 can also be shaped in another structure where they are inclined towards the lower portion, and as a result the width of said tooth space 14 would vary from a wider upper portion to a narrower lower portion.

Figure 6:
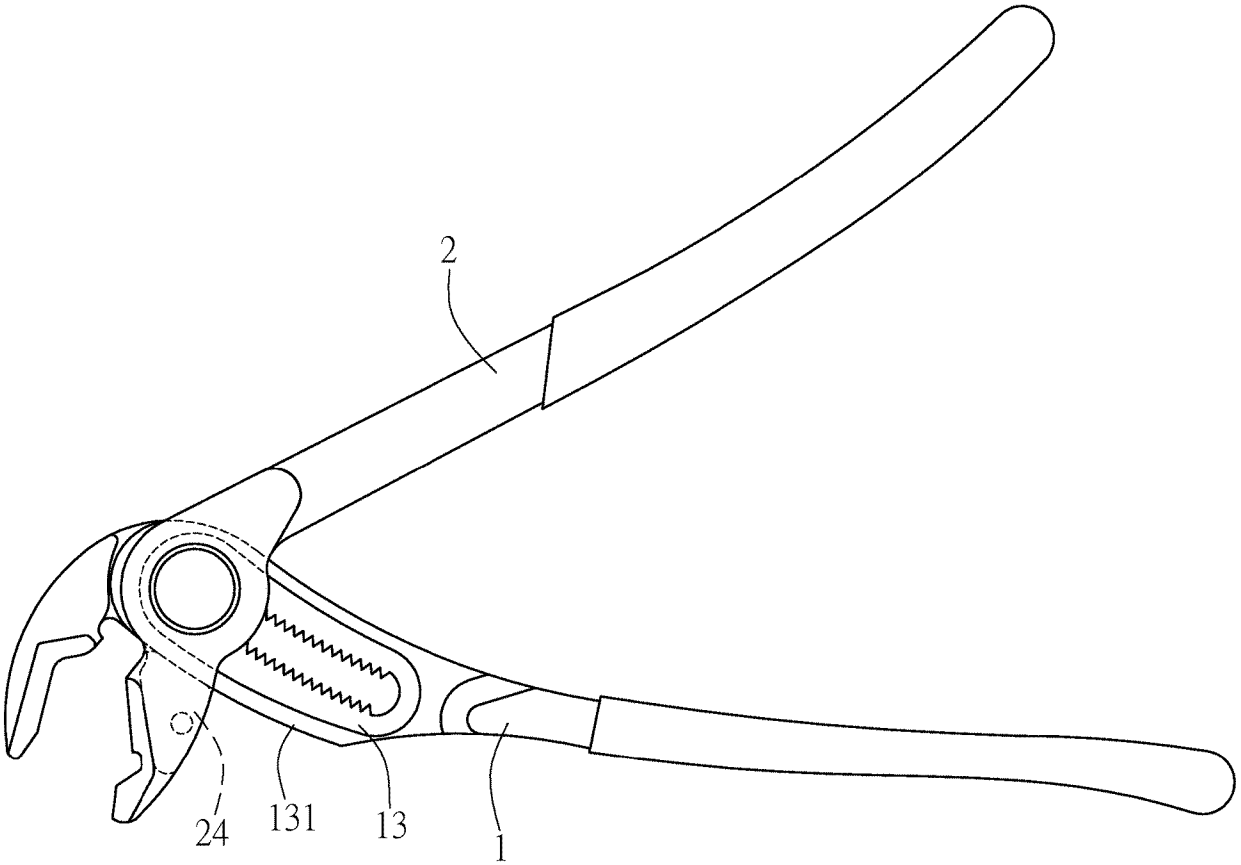
FIG. 6 is a drawing that shows the usage view during opening up of the present invention.
Figure 10:
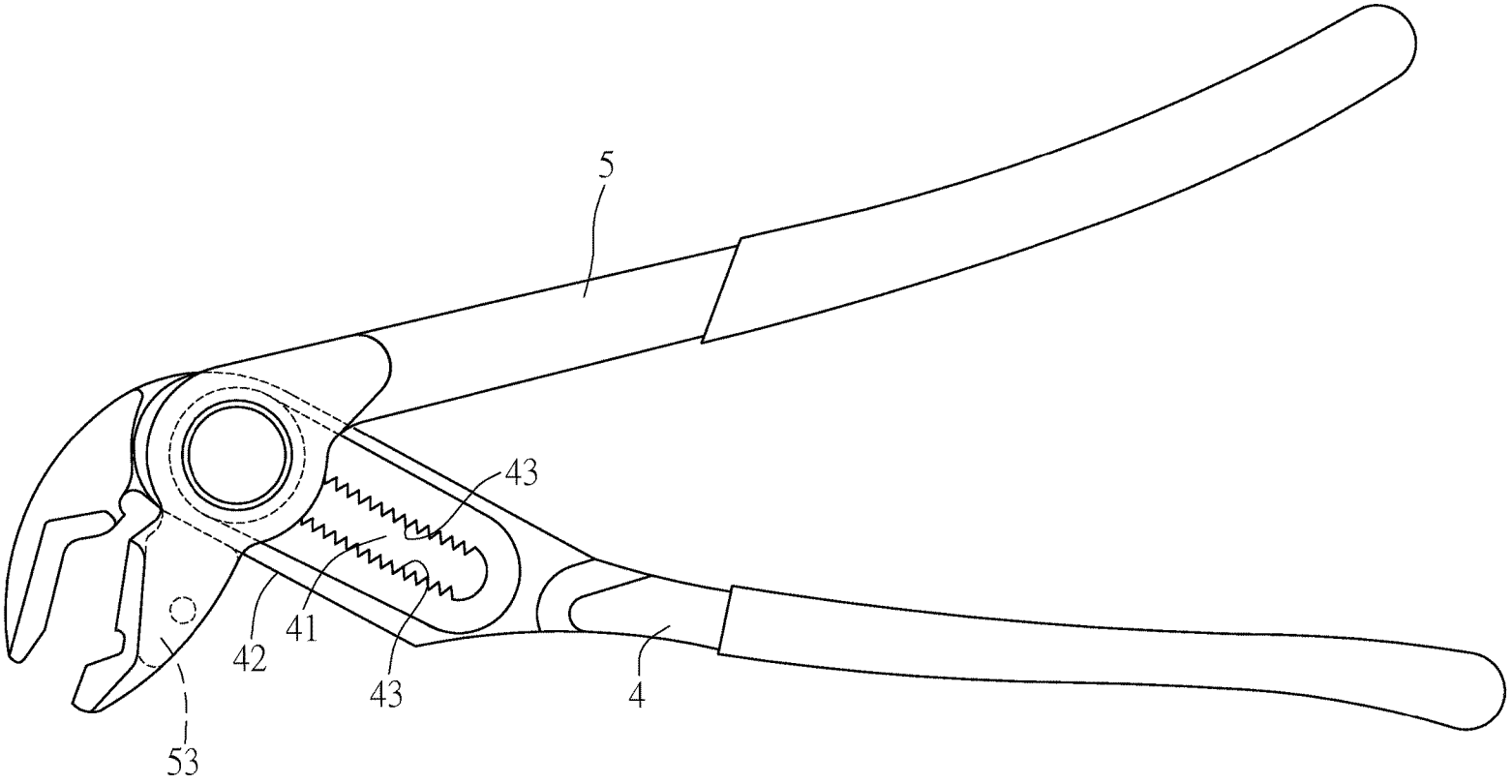
FIG. 10 PRIOR ART
FIG. 10 is a plan view drawing of the prior art structure.
Figure 11:
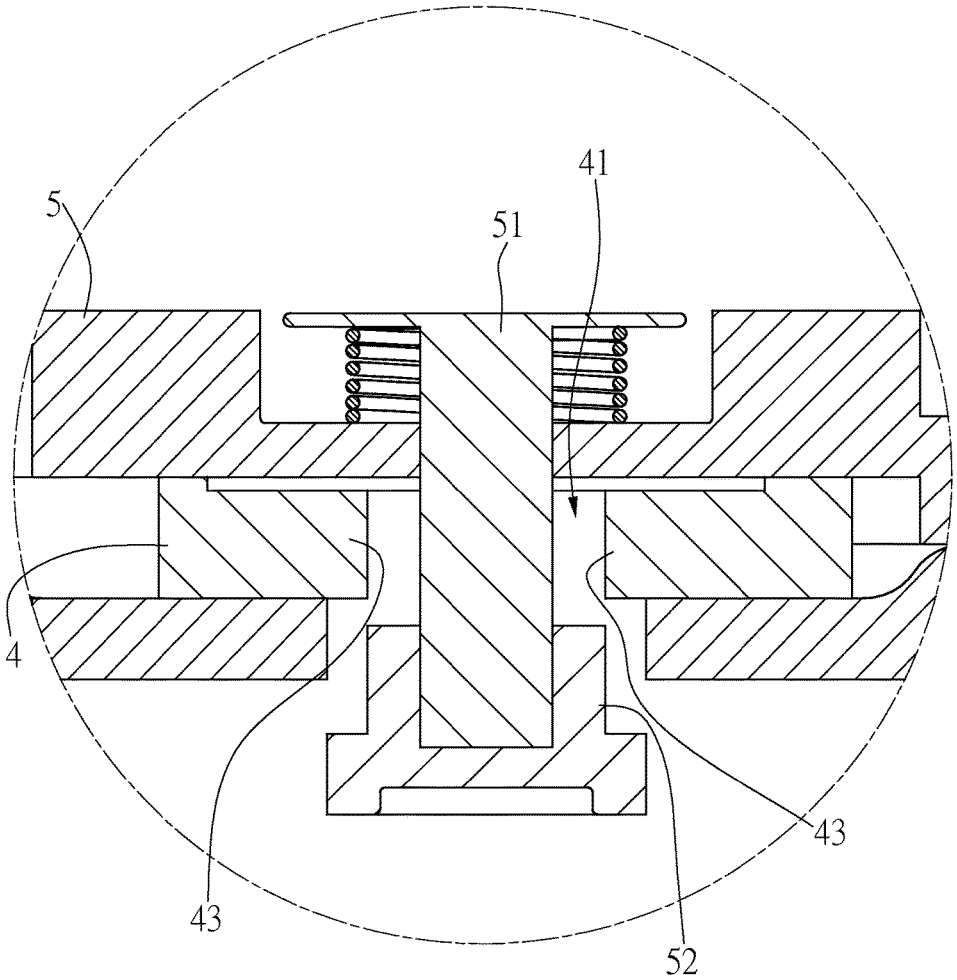
FIG. 11 PRIOR ART
FIG. 11 is a section view drawing of the prior art structure during use.

On the other hand, said second wrench body 2 comprises a perforation 23 with a stepped surface 231 between said second clamping piece 21 and said second handle piece 22, and said second wrench body 2 and therefore the perforation 23 directly face the tooth space 14 of said first wrench body 1 and also intersect with said first wrench body 1 on top of each other. Moreover, a control component 3 is passed through said perforation 23 and said tooth space 14 in order to pin joint said first wrench body 1 and said second wrench body 2. Among these, a blocking piece 24 is positioned near said second clamping piece 21 of said second wrench body 2, and thus, when said second wrench body 2 is opened with regard to said first wrench body 1, said blocking piece 24 is blocked by the side face 131 of the actuating piece 13 of said first wrench body 1, so that the opening up width of said second wrench body would be restricted. As shown in FIG. 6, the arc-shaped structure of the side face 131 of the actuating piece 13 of said first wrench body 1 would increase the opening up width of said second wrench body 2 as compared to the long straight-shaped prior art structure shown in FIG. 10, and thereby increase the clamping diameter of the water pipe wrench and make it more convenient during use.

Besides, as shown in FIG. 3, the present embodiment also comprises a bridge joint component 25. This bridge joint component 25 and said second wrench body 2 together clamp the first wrench body 1. In other words, the middle part of said bridge joint component 25 has an arched portion 253, and the two end parts 254 of said arched portion 253 individually comprises a connection hole 251. On the other hand, two connection blocks 26 are positioned on said second wrench body 2 in the form of protrusions, and these two connection blocks 26 are individually placed at the two sides of the actuating piece 13 of said first wrench body 1. Accordingly, said bridge joint component 25 and said arched portion 253 straddle over the actuating piece 13 of said first wrench body 1, so that the connection holes 251 found at both sides and the two connection blocks 26 of said second wrench body 2 would be connected. In this way, said bridge joint component 25 is fixed on said second wrench body 2, and clamp the first wrench body 1 together with said second wrench body 2.

Moreover, the arched middle portion of the above said bridge joint component 25, while intersecting said first wrench body 1 with said second wrench body 2 in order to pin joint, at the same time, it can maintain the forging flow line to postpone its extending shape, so that prevents each one of the wrench bodies from being bent. Accordingly, the two wrench bodies 1, 2 would achieve the effect of high bending strength due to their shapes, and also by means of said bridge joint component 25, both of them would be stably connected.

Figure 7:
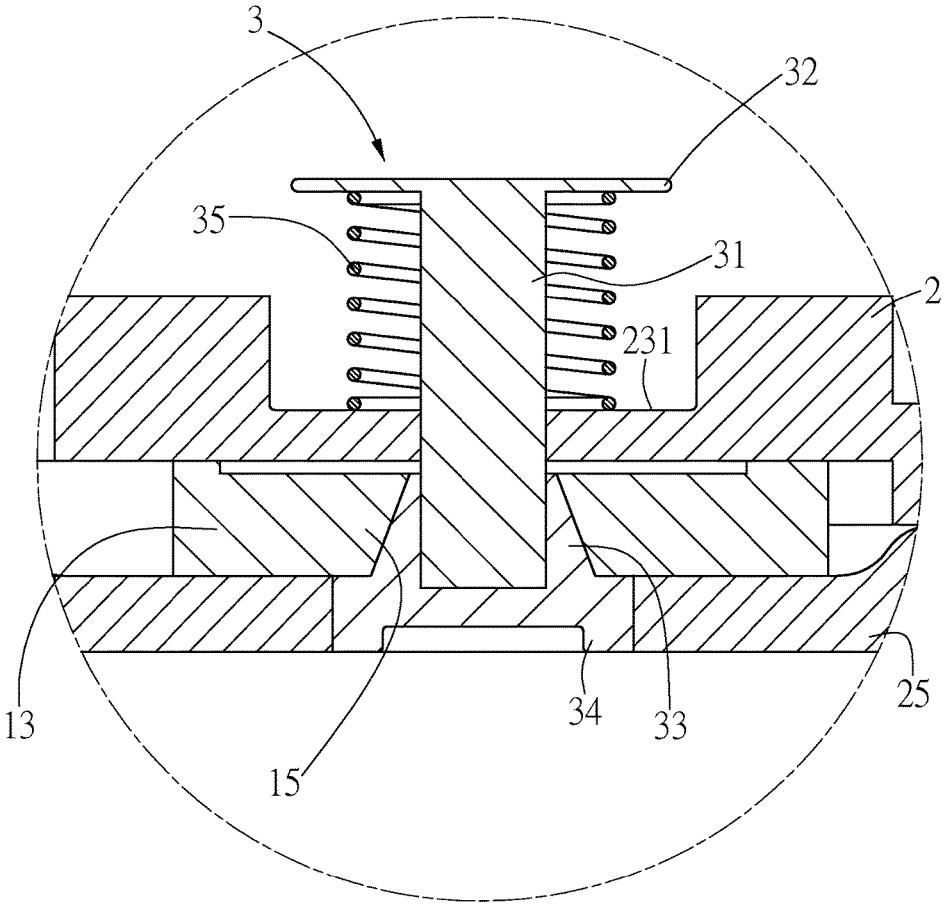
FIGS. 7 and 8 are section view drawings of the present invention's control component during use.

The positions of the pin joints of both above said first wrench body 1 and said second wrench body 2 can be adjusted via said control component 3 in order to set the desired clamping diameter for use. In other words, as shown in FIGS. 2 and 7, said control component 3 comprises a column piece 31, wherein the outer diameter of said column piece 31 is smaller than the width of said tooth space 14. A pressing piece 32 is found at the top of said column piece 31, and the bottom part is encircled within a grinding tooth piece 33 and a base plate 34. In the present embodiment, said grinding tooth piece 33 corresponds to the shape of said tooth piece 14 and thereby forms a trapezoidal shape, and thus fits and engages with the teeth 15 found in the tooth space. The column piece 31 of said control component 3 is passed through said perforation 23 and said tooth space 14, and said pressing piece 32 is positioned on top of said stepped surface 231. Said grinding tooth piece 33 engages the teeth 15 of said tooth space 14, and said base plate 34 is placed into a through hole 252 of said bridge joint component 25.

The position of the above said grinding tooth piece 33 can be changed by controlling said control component 3. In this embodiment, as shown in FIG. 7, a flexible component 35 is positioned around the column piece 31 of said control component 3. The flexible component 35 positioned at this place is a spring, the two ends of which are pushed against said pressing piece 32 and the stepped surface 231 of said perforation, respectively; and thereby it would push against said pressing piece 32 elastically so that said grinding tooth piece 33 can normally engage into said tooth space. Moreover, when the user presses on said pressing piece 32 as shown in FIG. 8, said flexible component 35 would be contracted, and said grinding tooth piece 33 would break away from said tooth space 14, so that the relatively fixed state between said first wrench body and said second wrench body would be relieved.

Figure 9:
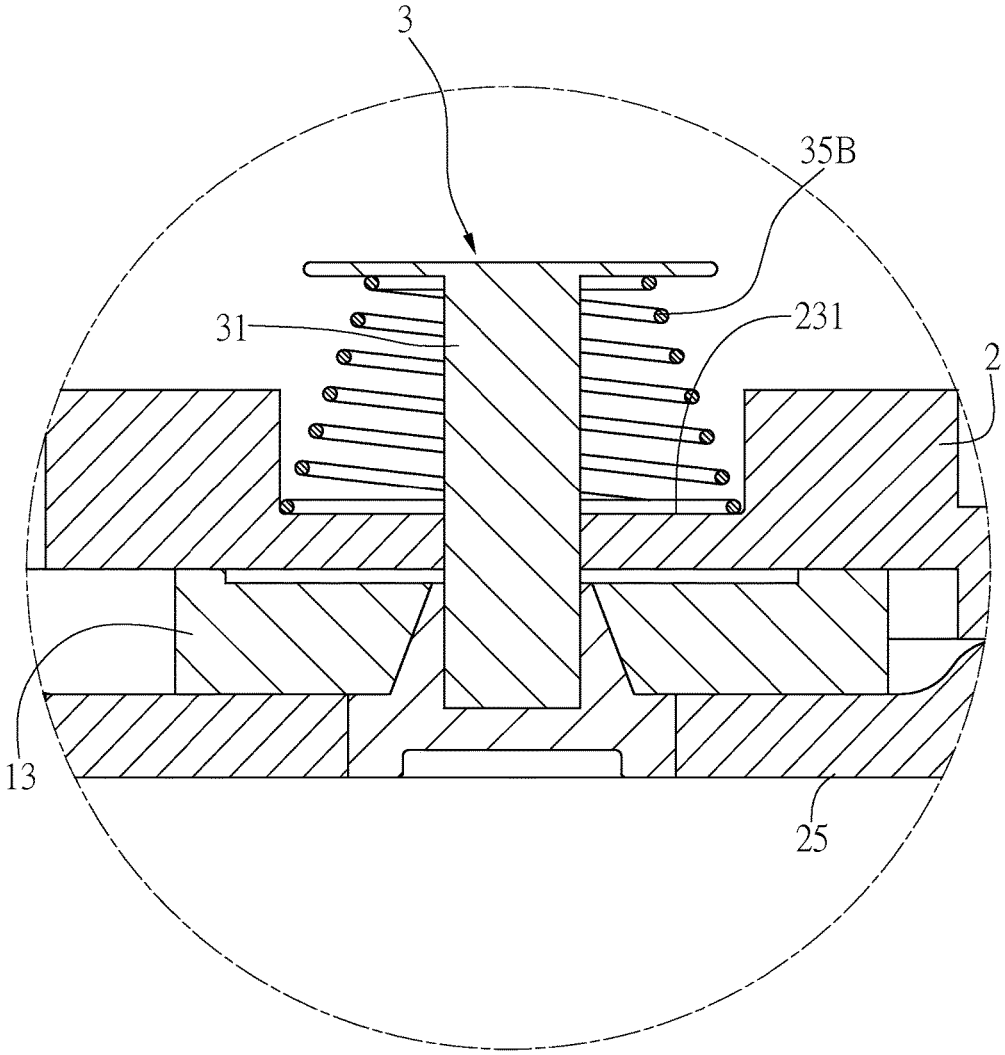
FIG. 9 is a drawing of another embodiment of the present invention's flexible component.

In another embodiment as shown in FIG. 9, said flexible component 35B can have a trapezoidal outer shape, or in other words, the diameters of the two ends of the component would be different; and accordingly, said flexible component 35B can have the appearance of the stepped surface 231 part in terms of aperture size and shape, and thus can be suitably mounted to the stepped surface 231 part, and as a result, a change in the external form of the flexible component 35B can improve its convenience in being installed/mounted on narrow spaces.

Figure 8:
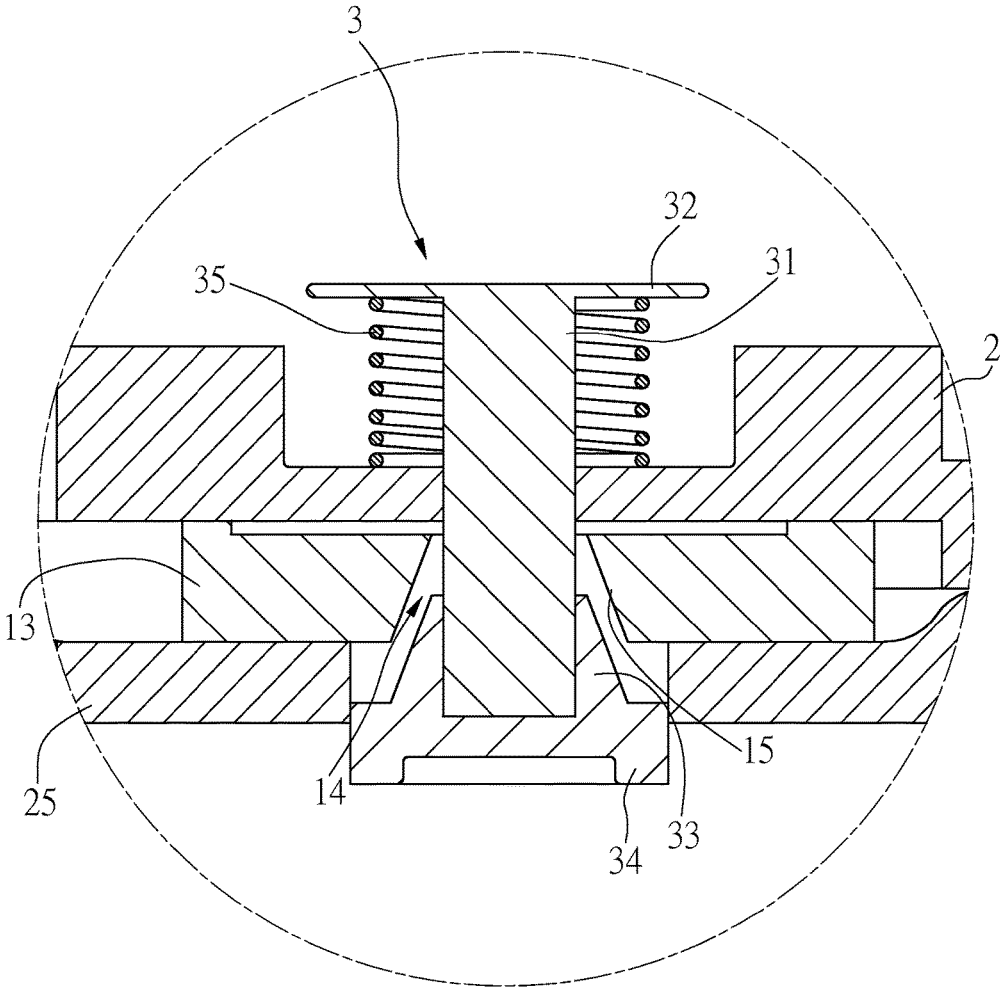

As shown in FIG. 8, due to the above mentioned shapes of said tooth space 14 and said grinding tooth piece 33, during use of said control component 3, the distance that said pressing piece 32 would move after being pressed on doesn't have to be very long, or in other words, said grinding tooth piece 33 doesn't need to be completely separated from said tooth space 14 in order to release said first wrench body from said second wrench body that are fixed to each other. In other words, only a little bit of pressing is required to separate said grinding tooth piece 33 from the teeth 15 found within said tooth space 14, and thereby the convenience during use would be even more improved.

Moreover, said grinding tooth piece 33 and the base plate 34 are manufactured by forging/metal injection, which can effectively mould metal and change the metal structure and reinforce metal efficiency, and thus change or adjust the course of the metal flow to be more consistent, or in other words, the external shape of said grinding tooth piece 33 and the base plate 34 can be given according to demand during the forging/metal injection process, and therefore can have relatively good clamping endurance, and thus retain the strength and endurance of the grinding tooth piece 33 during operation.

The invention claimed is:

1. A water pipe wrench structure comprising:

a first wrench body;

the first wrench body comprising a first clamping piece, a first handle piece, an actuating piece, a penetrating tooth space and a plurality of teeth;

the first clamping piece and the first handle piece being located at two ends of the first wrench body, respectively;

the actuating piece being positioned in between the first clamping piece and the first handle piece;

the penetrating tooth space penetrating through the actuating piece;

the actuating piece comprising two inner lateral sides;

the penetrating tooth space being formed in between the two inner lateral sides;

the plurality of teeth being disposed on the two inner lateral sides, separately;

a distance between the plurality of teeth disposed on the two inner lateral sides being defined as a width of the penetrating tooth space;

the penetrating tooth space comprising a curved shape;

the curved shape of the penetrating tooth space extending towards the first handle piece;

the actuating piece comprising a side edge;

the side edge comprising a curved shape;

the curved shape of the side edge corresponding to the curved shape of the penetrating tooth space;

a second wrench body;

the second wrench body comprising a second clamping piece, a second handle piece, a perforation and a blocking piece;

the second clamping piece and the second handle piece being located at two ends of the second wrench body, respectively;

the perforation comprising a stepped surface;

the perforation being positioned in between the second clamping piece and the second handle piece;

the second wrench body being pivoted on the first wrench body;

the perforation directly facing the penetrating tooth space;

the blocking piece being positioned near the second clamping piece;

in response to the second wrench body being opened with regard to the first wrench body, the blocking piece being blocked by the side edge so as to limit an opening up width of the second wrench body;

a control component the control component comprising a column piece, a pressing piece, a grinding tooth piece and a base plate;

the column piece comprising an outer diameter, a top and a bottom;

the outer diameter being smaller than the width of the penetrating tooth space;

the pressing piece being connected with the top;

the grinding tooth piece and the base plate being connected with the bottom;

the column piece penetrating through the perforation and the penetrating tooth space;

the pressing piece being positioned above the stepped surface;

a position of the grinding tooth piece being capable of being changed by pressing on the pressing piece so as to render the grinding tooth piece engaging with or breaking away from the plurality of teeth;

a bridge component;

the penetrating tooth space comprising a lower side and an upper side;

the bridge component and the second wrench body being separately positioned at the lower side and the upper side;

the bridge component and the second wrench body being solidly jointed;

the base plate penetrating through the bridge component;

in response to upper parts of the plurality of teeth disposed on the two inner lateral sides extending towards each other, the width of the penetrating tooth space being narrower at an upper end and being wider at a lower end;

in response to lower parts of the plurality of teeth disposed on the two inner lateral sides extending towards each other, the width of the penetrating tooth space being wider at the upper end and being narrower at the lower end;

the grinding tooth piece corresponding to a shape and the width of the penetrating tooth space;

a forging flow line of the first wrench body extending along an extension direction of the first wrench body; and a forging flow line of the second wrench body extending along an extension direction of the second wrench body.

2. The water pipe wrench structure according to claim 1 comprising:

a flexible component;

the flexible component being positioned around the column piece; and two ends of the flexible component being pushed against the pressing piece and the stepped surface, respectively.

3. The water pipe wrench structure according to claim 2 comprising:

outer diameters of the two ends of the flexible component being different.

4. The water pipe wrench structure according to claim 1 comprising:

two connection blocks;

the two connection blocks being positioned on the second wrench body;

the two connection blocks being in the form of protrusions;

the two connection blocks being individually placed at two sides of the actuating piece; and two ends of the bridge component being separately fixed on the two connection blocks.

* * * * *